US007753369B2

(12) United States Patent
Schalk et al.

(10) Patent No.: US 7,753,369 B2
(45) Date of Patent: Jul. 13, 2010

(54) MECHANICALLY TRIGGERED NIP DRIVE SHAFT

(75) Inventors: Wesley R. Schalk, Camas, WA (US); Allan G. Olson, Camas, WA (US); Raymond C. Sherman, Camas, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 380 days.

(21) Appl. No.: 11/741,697

(22) Filed: Apr. 27, 2007

(65) Prior Publication Data

US 2008/0265486 A1 Oct. 30, 2008

(51) Int. Cl.
*B65H 5/00* (2006.01)

(52) U.S. Cl. ..... 271/225; 271/258.01

(58) Field of Classification Search ..... 271/225, 271/258.01, 265.01, 266, 902
See application file for complete search history.

(56) References Cited

U.S. PATENT DOCUMENTS

| | | | | |
|---|---|---|---|---|
| 3,966,189 | A * | 6/1976 | Taylor et al. | 271/34 |
| 4,473,222 | A | 9/1984 | Simmons et al. | |
| 4,529,188 | A | 7/1985 | Sturnick | |
| 4,645,192 | A | 2/1987 | Watanabe | |
| 4,929,105 | A * | 5/1990 | Hirayama et al. | 400/625 |
| 5,806,992 | A * | 9/1998 | Ju | 400/56 |
| 2005/0017433 | A1 * | 1/2005 | Otsuki et al. | 271/121 |

* cited by examiner

*Primary Examiner*—Patrick Mackey
*Assistant Examiner*—Michael C McCullough

(57) ABSTRACT

Various embodiments and methods relating to a mechanically triggered nip drive shaft are disclosed.

26 Claims, 9 Drawing Sheets

MECHANICALLY TRIGGERED NIP DRIVE SHAFT

BACKGROUND

Sheets of media may sometimes become skewed as they are being fed. Correcting such skew may add cost and complexity while decreasing throughput.

DETAILED DESCRIPTION OF THE EXAMPLE EMBODIMENTS

Figure 1:
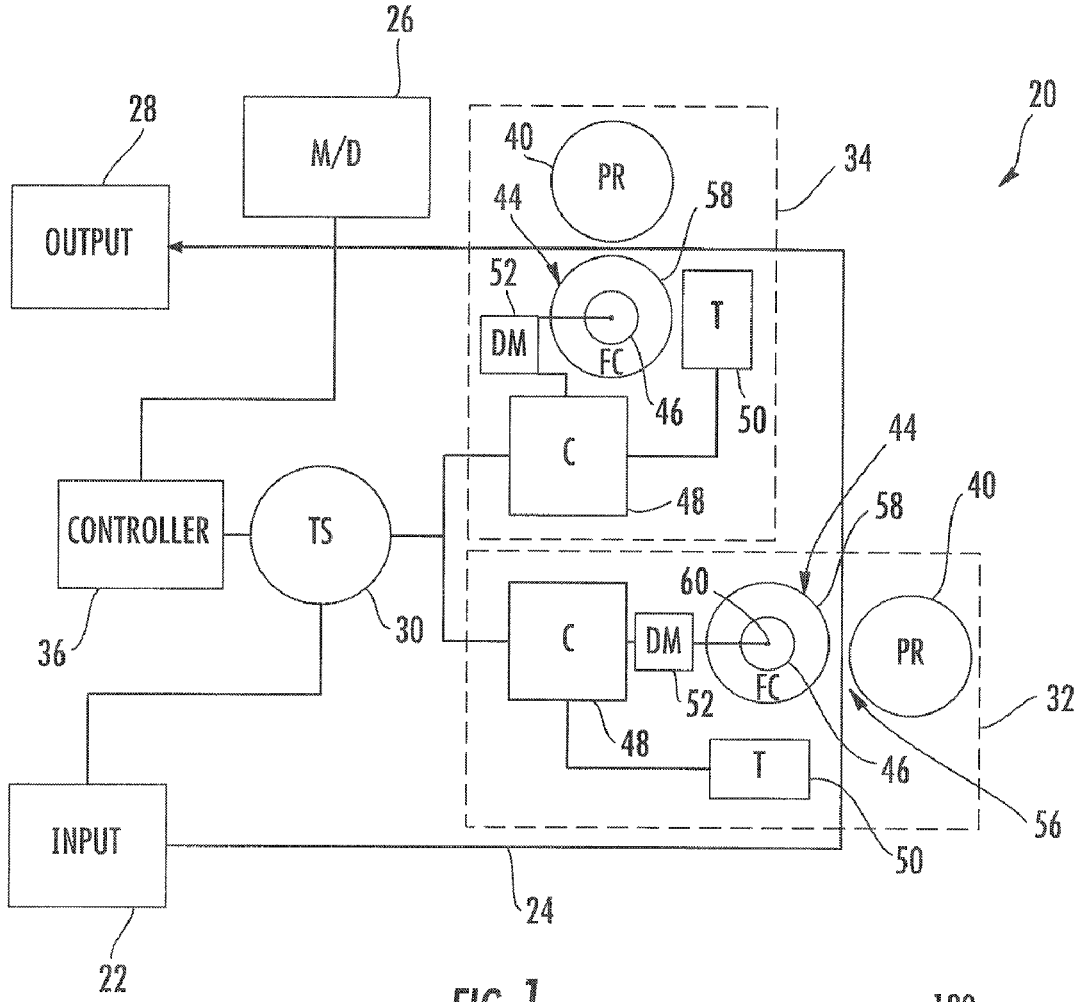
FIG. 1 is a schematic illustration of a media interaction system according to an example embodiment.

FIG. 1 schematically illustrates media interaction system 20 according to an example embodiment. Media interaction system 20 is configured to interact with sheets of media. As will be described hereafter, media interaction system 20 reduces or eliminates skew of the sheets to be interacted upon in a cost effective and less complex manner without substantially reducing throughput.

Media interaction system 20 includes media input 22, media path 24, media interaction device 26, media output 28, torque source 30, deskewing systems 32, 34 and controller 36. Media input 22 comprises one or more structures by which sheets of media are supplied to media interaction system 20. Media input 22 is further configured to initiate movement of such individual sheets along media path 24. In one embodiment, media input 22 may include a tray, bin or other storage structure by which a stack of sheets or an individual sheet may be loaded into system 20. Such loading may be manually or may be from another media interaction system. In particular embodiments, media input 22 may additionally include one or more pick tires configured to selectively pick and separate sheets from a stack and to initiate movement of such picked sheets along media path 24. In embodiments where individual sheets are supplied to input 22, either manually or from another media interaction system, such pick tires may be omitted.

Media path 24 comprises a passageway for sheets of media which extends from input 22 across media interaction device 26 and to output 28. Media path 24 may be defined by one or more stationary or moving structures. For example, media path 24 may be defined by platens, stationary panels, movable sheet diapers, driven and pinch roller pairs or other guiding structures or mechanisms. In the particular embodiment illustrated, deskewing systems 32, 34 further assist in moving sheets along media path 24.

Media interaction device 26 comprises one or more devices configured to interact with sheets supplied along media path 24 from input 22. In one embodiment, media interaction device 26 interacts with such sheets by printing images, text, graphics and the like upon such sheets. For example, in one embodiment, media interaction device 26 may comprise one or more drop-on-demand inkjet print heads. In one embodiment, such print heads may be scanned across such sheets. In another embodiment, such print heads may be provided as part of a page-wide-array of print heads. In yet other embodiments, media interaction device 26 may comprise an electrophotographic printing device.

In yet other embodiments, media interaction device 26 may be configured to interact with sheets of media in other fashions. For example, in another embodiment, media interaction device 26 may be configured to sense, read or scan information from such sheets. For example, media interaction device 26 may be provided as part of a scanner, copier or fax machine. In yet other embodiments, media interaction device 26 may be configured to physically alter sheets such as by creasing, folding, stapling or binding such sheets.

Output 28 comprises one or more structures configured to receive sheets that have been interacted upon. Output 28 may comprise a tray, bin or other storage device configured to store sheets and provide a person with access to the sheets. In yet other embodiments, output 28 may be configured to further direct such sheets back to media interaction device 26 for duplex printing or multi-sided scanning. In still other embodiments, output 28 may be configured to further direct such sheets to a different external media interaction system.

Torque source 30 comprises one or more sources of torque for driving components of media interaction system 20. For example, in one embodiment, torque source 30 may comprise one or more motors. Torque source 30 is operably connected to the components by one or more transmissions. Such transmissions, power trains or drive trains may include a gear trains, chain and sprocket arrangements, belt and pulley arrangements or combinations thereof. In the particular embodiment illustrated, torque source 30 supply torque to media input 22 as well as to each of deskewing systems 32, 34.

Deskewing systems 32 and 34 comprise arrangements of components situated along media path 24 that are configured to assist in moving sheets of media along media path 24. Deskewing systems 32 and 34 are further configured to reduce or eliminate skew of such sheets. Deskewing systems 32 and 34 are substantially similar to one another except that deskewing system 32 is located upstream of deskewing system 34. For ease of discussion, the remaining description will describe deskewing system 32.

Deskewing system 32 moves sheets along media path 24 and also assists in reducing or eliminating skew of such sheets deskewing system 32 produces skew of such sheets with a reduced reliance or no reliance upon sensors and without torque source 30 having to be stopped or reversed to effectuate skew reduction. Deskewing system 32 includes pinch roller 40, nip drive shaft 44, friction clutch 46, clutch 48, trigger 50 and dwell mechanism 52. Pinch roller 40 comprises one or more rollers located opposite to nip drive shaft 44. Pinch roller 40 idles or rotates while being pressed towards nip drive shaft 44. Pinch roller 40 cooperates with nip drive shaft 44 to form a nip 56 by which sheets are pinched while being driven along media path 24.

Nip drive shaft 44 comprises a shaft supporting one or more rollers 58 which extend opposite to pinch roller 40. Nip drive shaft 44 is rotationally driven about axis 60 in response to receiving torque from torque source 30 via clutch 48. When nip drive shaft 44 is being driven in a counterclockwise direction as seen in FIG. 1, nip drive shaft 44 engages a sheet within nip 56 and drives a sheet further along media path 24. When nip drive shaft 44 is not being driven (in neutral) or is being driven in a reverse direction opposite to the direction of media path 24 (in a clockwise direction as seen in FIG. 1), nip drive shaft 44 cooperates with pinch roller 40 such that the leading edge of a sheet cannot pass through and beyond nip 56. As the leading edge of the sheet is driven against nip 56, the leading edge is squared in nip 56, lessening skew of a sheet.

Friction clutch 46 comprises a clutch operably coupled to nip drive shaft 44 and configured to impede rotation of nip drive shaft 44 when torque is not being supplied to drive shaft 44 via clutch 48. Friction clutch 46 inhibits the leading edge of the sheet from being pushed through nip 56 when drive shaft 44 is not being driven. In particular embodiments, such as in embodiments where nip drive shaft 44 is driven in a reverse direction (clockwise as seen in FIG. 1) during skewing, friction clutch 46 may be omitted.

Clutch 48 comprises a mechanism configured to selectively operably couple or connect torque source 30 to nip drive shaft 44, either directly or via dwell mechanism 52. For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. The term "operably coupled" shall mean that two members are directly or indirectly joined such that motion may be transmitted from one member to the other member directly or via intermediate members.

Clutch 48 actuates between a first driving state in which clutch 48 transmits torque to drive shaft 44 so as to drive drive shaft 44 in a direction to advance media along media path 24 (counterclockwise as seen in FIG. 1) and a second deskewing state. In one embodiment, when in the second deskewing state, clutch 48 interrupts or ceases transmission of torque from torque source 30 to drive shaft 44. As a result, drive shaft 44 is in a substantially stationary or neutral state. In another embodiment, when in the second deskewing state, clutch 48 reverses the direction in which torque is applied to drive shaft 44 such that drive shaft 44 is driven in a reverse direction so to urge any engaged sheet in a direction along media path 24 back towards input 22. In one embodiment, clutch 48 may be resiliently biased towards one of the driving state or the deskewing state. Clutch 48 is mechanically actuated between the driving state and the deskewing state by trigger 50.

Trigger 50 comprises an arrangement of structures or components configured to utilize force exerted by a sheet upon trigger 50 to mechanically actuate clutch 48 between the driving state and the deskewing state. In one embodiment, force exerted upon trigger 50 by a sheet is directly transmitted by trigger 50 to clutch 48 to move one or more components of clutch 48 so as to change the state of clutch 48.

In another embodiment, force exerted upon trigger 50 by a sheet is transmitted by trigger 50 so as to move an intermediate movable structure which connects or disconnects a separate distinct source of torque or motion to clutch 48, wherein the distinct source of torque or motion, when connected to clutch 48, moves one or more components of clutch 48 so as to change the state of clutch 48. For example, in one embodiment, trigger 50 may include driven gear supported by a swing arm, wherein force exerted upon trigger 50 by a sheet moves the swing arm to engage or disengage the driven gear with a corresponding gear associated with clutch 48 to actuate clutch 48 to either the driving state or the deskewing state.

According to one embodiment, clutch 48 is resiliently biased towards the driving state. At the same time, trigger 50 is resiliently biased to a clutch engaging position in which trigger 50 overcomes the bias of clutch 48 to maintain clutch 48 in the deskewing state. Upon being tripped by force from a driven sheet, trigger 50 is moved against its bias out of the clutch engaging position, permitting the bias of clutch 48 to return clutch 48 to the driving state.

According to another embodiment, clutch 48 is resiliently biased towards a deskewing state. Upon encountering a sheet along media path 24 such that force is received from the sheet, trigger 50 transmits the received force so as to actuate clutch 48 against the bias to the driving state. As a result, the triggering of trigger 50 by a sheet switches clutch 48 from the deskewing state to the driving state.

In embodiments where trigger 50 is tripped prior to the leading edge of the sheet contacting or being squared against nip 56 while drive shaft 44 is in the deskewing state, the actual changing of clutch 48 or the actual time at which drive shaft 44 receives torque via clutch 48 to drive drive shaft 44 in the media advancing direction is delayed a sufficient amount of time such that the leading edge of the sheet may yet be squared against nip 56 after tripping of trigger 50. In other embodiments, trigger 50 may be located so as to be tripped shortly after squaring of the leading edge of the sheet in nip 56.

After switching from the deskewing state to the driving state, clutch 48 begins transmitting torque from torque source 30 to nip drive shaft 44. Upon receiving such torque, nip drive shaft 44 proceeds by rotating in the media advancing direction so as to drive the squared sheet further along media path 24. Further squaring of the sheet is subsequently performed by deskewing system 34 prior to being interacted upon by media interaction device 26. In other embodiments, deskewing system 34 may be omitted or additional deskewing systems similar to deskewing systems 32, 34 may be provided before or after media interaction device 26.

Dwell mechanism 52 comprises a mechanism configured to delay transmission of force or motion. In the particular embodiment illustrated, dwell mechanism 52 comprises a lost motion arrangement located between clutch 48 and nip drive shaft 44. Dwell mechanism 52 delays transmission of torque from clutch 48 (when clutch 48 has been changed to the driving state) to drive shaft 44. As a result, even after clutch 48 has been changed to the driving state by trigger 50, nip drive shaft 44 remains in the deskewing state until the dwell provided by dwell mechanism 52 has been consumed. Dwell mechanism 52 provides a dwell time sufficient for the leading edge of the sheet to move past trigger 50 and to be squared against nip and 56 prior to rotation of nip drive shaft 44 in the media advancing direction. Once the dwell has been consumed, drive shaft 44 is rotationally driven in the media advancing direction to move the squared sheet along media path 24.

According to one embodiment, dwell mechanism 52 may comprise two consecutive movable members joined to one another by a pin, tab or other projection extending from one of the members into a slot provided in the other of the members. The slot defines two shoulders against one of which the pin or tab engages to transfer motion in a direction. A resilient bias, such a spring, urges the pin or tab against a first one on the shoulders. The time that it takes for the tab to move against the bias, across the length of the slot and into engagement with the other of the shoulder to transfer motion constitutes the dwell time provided by this dwell mechanism. In other embodiments, dwell mechanism 52 may have other configurations.

Although dwell mechanism 52 is illustrated as being provided between clutch 48 and drive shaft 44 for delaying transmission of torque to drive shaft 44 even after clutch 48 has been actuated to the driving state, in other embodiments, dwell mechanism 52 may be provided at other locations. For example, in one embodiment, dwell mechanism 52 may alternatively be provided between trigger 50 and clutch 48 or as a part of trigger 50. In such an embodiment, the dwell mechanism 52 delays transfer of motion or force from trigger 50 to clutch 48 to delay switching of clutch 48 from the deskewing state to the driving state even after trigger 50 has been tripped. Once again, the delayed provided by such a dwell mechanism is sufficient to permit the driven sheet to continue to move past trigger 50 into squaring abutment with nip 56 prior to drive shaft 44 receiving torque so as to be driven in a media advancing direction. In yet other embodiments, dwell mechanism 52 may be provided between clutch 48 and nip drive shaft 44 and also between trigger 50 and clutch 48. In still other embodiments, dwell mechanism 52 may alternatively or additionally be provided between torque source 30 and clutch 48.

Controller 36 comprises one or more processing units configure to generate control signals directing operation of one or more components media interaction system 20. In the particular example shown, controller 36 generates control signals directing operation of at least to media interaction device 26 and torque source 30. For purposes of this application, the term "processing unit" shall mean a presently developed or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. For example, controller 36 may be embodied as part of one or more application-specific integrated circuits (ASICs). Unless otherwise specifically noted, the controller is not limited to any specific combination of hardware circuitry and software, nor to any particular source for the instructions executed by the processing unit.

In operation, according to one embodiment, upon loading of one or more sheets into input 22 and upon either sensing of such loading or upon receiving a command to initiate interaction with the one or more sheets, controller 36 generates control signals directing torque source 30 to supply torque to input 22 to move a sheet from input 22 along media path 24. Upon a leading edge of the driven sheet tripping trigger 50, clutch 48 is subsequently changed from the deskewing state to the driving state. Dwell mechanism 52 delays receipt of torque by nip drive shaft 44 for a sufficient period of time such that the leading edge of the driven sheet abuts and is at least partially squared against nip 56 while drive shaft 44 is still in the deskewing state. In one embodiment, drive shaft 44 is stationary or neutral while in the deskewing state. After the dwell provided by dwell mechanism 52 has been consumed, torque is delivered to drive shaft 44 which rotates in the media advancing direction, driving the sheet through nip and 56 further along media path 24.

Upon the leading edge of the driven sheet tripping trigger 50 of deskewing system 34, the same process is repeated to further square sheet. Such deskewing may reduce skew which may have occurred as a sheet traveling between systems 32 and 34 or may provide additional squaring of the sheet. In the particular example embodiment illustrated, clutches 48 of both deskewing systems 32 and 34 concurrently receive torque from torque source 30. Because actuation of deskewing systems 32 and 34 may occur without reversal of torque source 30, both deskewing systems 32 and 34 may be concurrently driven by a single torque source 30 while clutches 48 of systems 32 and 34 are both in either the same state or different states. In other embodiments, system 20 may be provided with additional or fewer deskewing systems 32 and 34 driven by the same torque source 30 or by additional torque sources.

After being sufficiently squared by deskewing systems 32 and 34, the sheet is driven further along media path 24 to media interaction device 26. Media interaction device 26 interacts with the sheet in one of the manners noted above. Because driven sheet has less skew, the sheet may be more accurately and reliably printed upon, scanned, folded, creased, stapled or bound. Upon being interacted upon by media interaction device 26, the sheet is discharged to output 28. In particular embodiments, such as where media interaction device 26 folds, binds, staples or otherwise interact with multiple sheets at once, the multiple interacted sheet may be concurrently discharged to output 28.

Figure 2:
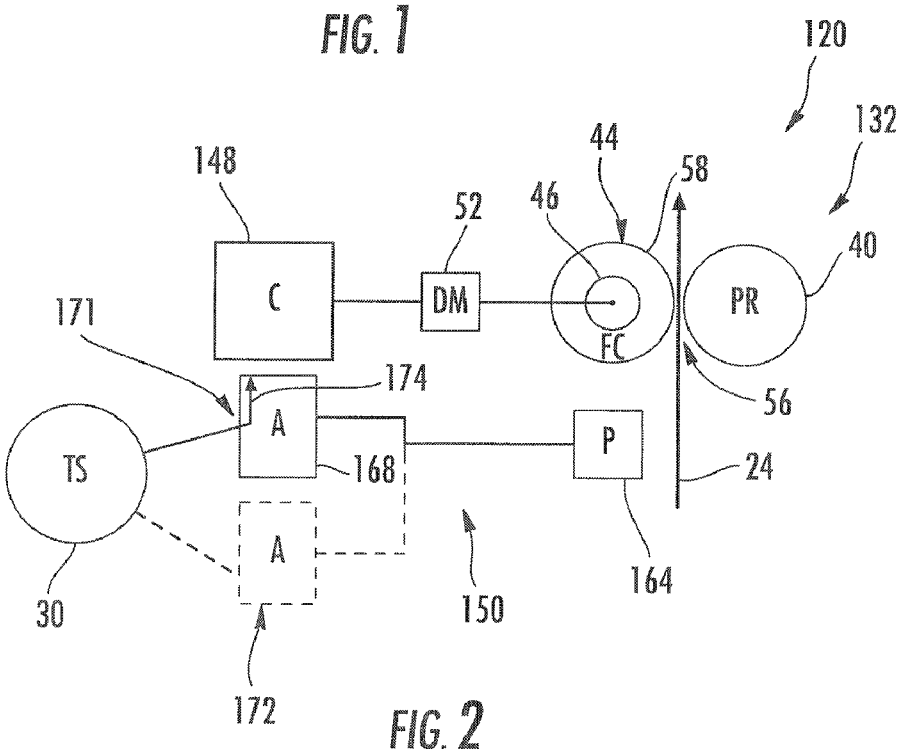
FIG. 2 is a schematic illustration of a portion of another embodiment of the media interaction system of FIG. 1 according to an example embodiment.
Figure 3:
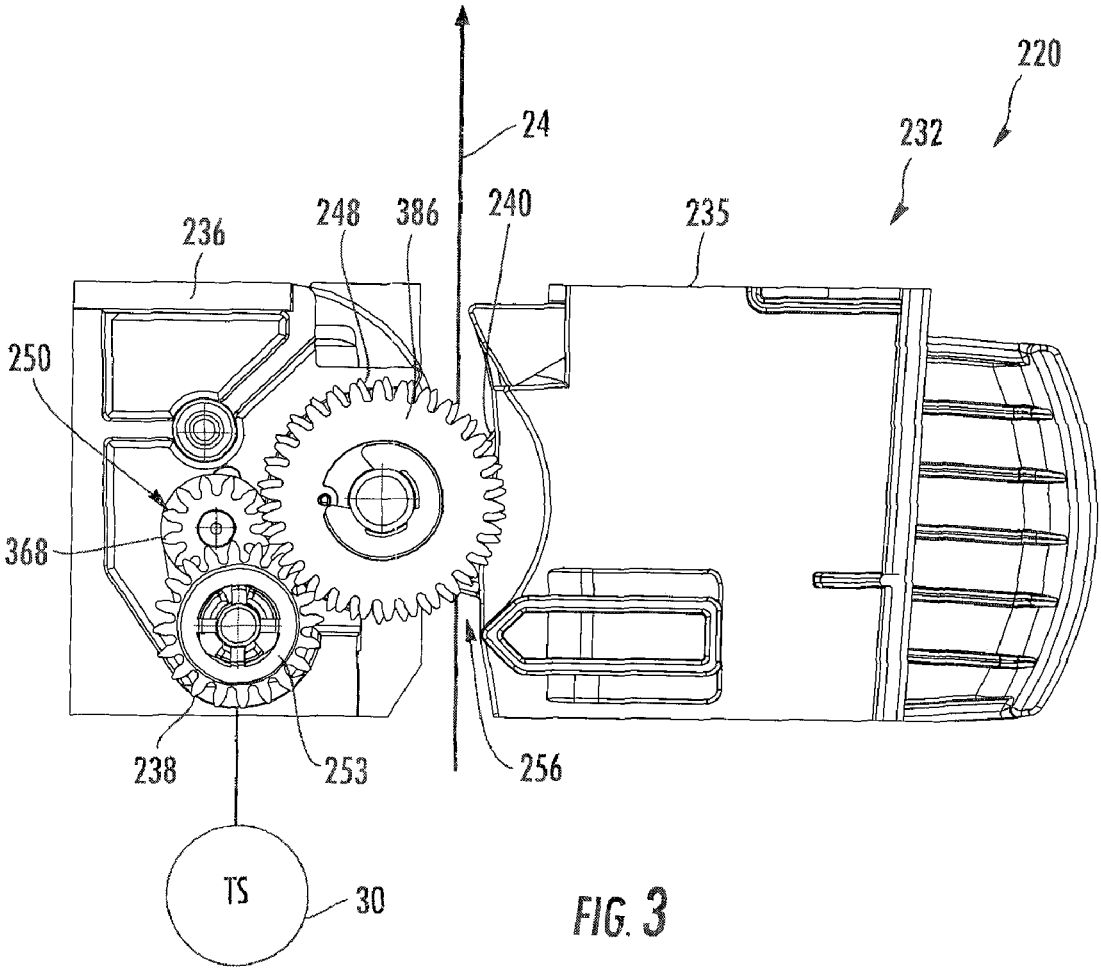
FIG. 3 is a side elevational view of a portion of another embodiment of the media interaction system of FIG. 1 according to an example embodiment.

FIG. 2 schematically illustrates media interaction system 120, another embodiment of media interaction system 20 shown and described with respect to FIG. 1. Media interaction system 120 includes input 22, media interaction device 26, output 28, torque source 30 and controller 36, all of which are schematically shown in FIG. 1. Media interaction system 120 additionally includes a pair of deskewing systems 132 (one of which is shown in FIG. 2) between input 22 and output 28. Deskewing system 132 comprises a particular example embodiment of deskewing system 32 (shown in FIG. 1). Deskewing system 132 is similar to deskewing system 32 described above with respect to FIG. 1 except that deskewing system 132 specifically includes trigger 150, a particular embodiment of trigger 50. Those remaining components of deskewing system 132 which correspond to deskewing system 32 are numbered similarly.

Trigger 150 comprises an arrangement of structures or components configured to utilize force exerted by a sheet upon trigger 150 to mechanically actuate clutch 148 between the driving state and the deskewing state. In one embodiment, force exerted upon trigger 150 by a sheet is directly transmitted by trigger 152 to move one or more components of clutch 148 so as to change the state of clutch 148. In the particular embodiment illustrated, force exerted upon trigger 150 by a sheet is transmitted by trigger 150 so as to move an intermediate movable structure which connects or disconnects a separate distinct source of torque or motion to clutch 148, wherein the distinct source of torque or motion, when connected to clutch 148, moves one or more components of clutch 148 so as to change the state of clutch 148.

As shown by FIG. 2, trigger 150 includes paddles 164 and an actuator 168 (schematically shown). Trigger paddle 164 comprise one or more paddles, wherein each paddle comprises a projection or extension that is movably supported between a media path intercepting position in which the paddle extends at least partially across and into media path 24 and a withdrawn position in which the paddle is out of media path 24, permitting a sheet to move past the paddle 164. In the particular embodiment illustrated, paddle 164 is resiliently biased towards the intercepting position such as with one or more springs. In other embodiments, such bias may be applied by gravity.

Paddle 164 is configured to encounter a sheet moving along media path 24 and to move so as to transmit force and motion to actuator 168 to move actuator 168. In one embodiment, paddle 154 may comprise a single paddle proximate to an input side of nip 56. In another embodiment, paddle 154 may comprise a plurality of paddles axially spaced along nip drive shaft 44 on the input side of nip 56.

Actuator 168 comprises a mechanical mechanism operably connected to paddle 164 such that the force exerted upon paddle 164 moves actuator 168 between a clutch engaged position 171 (shown in solid lines) and a clutch disengaged position 172 (shown in broken lines). In the clutch engaged position 171, actuator 168 engages clutch 148 so to change clutch 148 from its default or biased state to its non-default state and to retain clutch 148 in the non-default state. In the clutch disengaged position 172, actuator 168 is withdrawn and separated from clutch 148 or sufficiently is engaged from clutch 148 to return, under bias, to its default state. For example, in one embodiment, clutch 148 is originally biased to the deskewing state, its default state. When actuator 168 is in the clutch engaged state, actuator 168 either disengages or overcomes the bias so as to move clutch 148 to the driving state, the non-default state. When actuator 168 is in the clutch disengaged state, clutch 148 is once again biased to its default driving state.

In the particular example shown in FIG. 2, and as schematically represented by arrow 174, actuator 168 utilizes torque or force from a source other than paddle 164 to overcome the biased default state of clutch 148 and to move clutch 148 to the non-default state. Actuator 168 uses force or motion received from paddle 164 for movement between the clutch engaged position or state 171 and the disengaged position or state 172. In the particular example illustrated, actuator 168 receives and utilizes torque from torque source 30.

In one embodiment, actuator 168 continues to receive torque from torque source 30 when actuator 168 is in either the clutch engaged state 171 or the clutch disengaged state 172. In another embodiment, actuator 168 may alternatively only receive torque from torque source 30 while in the clutch engaged state 171. In yet other embodiments, actuator 168 may receive torque or force from a separate torque source. In still other embodiments, actuator 168 may not receive torque from an additional source, where force or motion provided by paddle 164 is sufficient to overcome the bias of clutch 148 to move clutch 148 to the non-default state.

In one embodiment, actuator 168 may include a swing arm carrying a gear or other torque coupling member that is driven by torque source 30. Force received and transmitted by paddle 164 pivots the swing arm to move the driven gear either into engagement with a corresponding gear associated with clutch 148 (the clutch engaged state) or out of engagement with the corresponding gear of clutch 148 (the clutch disengaged state). In one embodiment, the swing arm may be resiliently biased towards one of the states, wherein force received from paddle 164 moves the swing arm against the bias to the other of the states. In the clutch engaged state, the driven gear transmits force to the corresponding gear of clutch 148 to overcome the bias of clutch 148 to move clutch 148 to the non-default state. As noted above, in one embodiment, the non-default state of clutch 148 may be the driving state.

FIGS. 3-6 illustrates media interaction system 220, the particular embodiment of media interaction system 20. Media interaction system 220 includes input 22, media interaction device 26, output 28, torque source 30 and controller 36, all of which are schematically shown in FIG. 1. Media interaction system 220 additionally includes a pair of deskewing systems 232 (one of which is shown in FIG. 3-6) between input 22 and output 28 (shown in FIG. 1). Deskewing system 232 comprises a particular example embodiment of deskewing system 32 (shown in FIG. 1).

Deskewing system 232 includes housings 235, 236, torque splitter 238, pinch rollers 240, nip drive shaft 244, friction clutch 246, clutch 248, trigger 250 and dwell mechanism 252. Housings 235, 236 (shown in FIG. 3) comprise frames, walls, supports or other structures configured to at least partially support components of deskewing system 232. Housing 235 rotationally supports pinch rollers 240 opposite to nip drive shaft 244. Housing 236 rotationally supports nip drive shaft 244. In the particular example illustrated, housing 236 further supports torque splitter 238, friction clutch 246, clutch 248, trigger 250 and dwell mechanism 252. Housings 235 and 236 may support other components of media interaction system 220 and may have other configurations.

Torque splitter 238 comprises one or more components operably coupled to torque source 30 (such as by a transmission) so as to receive torque from torque source 30 and so as to deliver torque to both nip drive shaft 244 via clutch 248 and dwell mechanism 252. In the particular embodiment illustrated, torque splitter 238 comprises a cluster gear rotationally supported about an axle or other extension (not shown) extending from housing 236. In one embodiment, torque splitter 238 is axially retained on the extension (not shown) by a retainer clip 253 (shown in FIG. 3). In such an embodiment, torque splitter 238 includes a first gear 300 in meshing engagement with dwell mechanism 252 and a second gear 302 in meshing engagement with a gear of trigger 250.

In other embodiments, torque splitter 238 may have other configurations. For example, torque splitter 238 may alternatively be mounted upon a separate drive shaft which is driven by torque source 30, wherein the gears 300 and 302 are supported in engagement with dwell mechanism 252 and trigger 250, respectively. In yet other embodiments, torque splitter 238 may comprise separate and independent gears, rather than a cluster gear, mounted to or otherwise provided on a drive shaft. In still other embodiments, torque splitter 238 may have other configurations for delivering torque to dwell mechanism 252 and trigger 250. In one embodiment, where torque is transmitted to dwell mechanism 252 and trigger 250 by a belt and pulley arrangement, torque splitter 238 may alternatively comprise a pair of pulleys and associated belts. In another embodiment where torque is transmitted to dwell mechanism 252 and trigger 250 by a chain and sprocket arrangement, torque splitter 238 and alternatively comprise a pair of the sprockets and associated chains. Such pairs of pulleys or such pairs of sprockets may be clustered together or maybe independent of one another.

Pinch rollers 240 (shown in FIG. 4) comprise rollers rotationally supported opposite to and against corresponding rollers 258 of nip drive shaft 244. Pinch rollers 240 are rotationally supported by housing 235 (shown in FIG. 3). In one embodiment, pinch rollers are resiliently biased towards rollers 258. Rollers 240 cooperate with rollers 258 to form nips 256. Although four pinch rollers 240 and four corresponding rollers 258 are illustrated, in other embodiments, greater or fewer of such opposite roller pairs may be provided.

Nip drive shaft 244 comprises a shaft supporting one or more rollers 258 which extend opposite to pinch rollers 240. Nip drive shaft 244 as a first end 304 (shown in FIG. 4) rotationally supported by housing 236 (shown in FIG. 3). Nip drive shaft 244 has a second end 307 (shown in FIG. 6) received within clutch 248. End 307 is rotationally supported by housing 236 via clutch 248 and dwell mechanism 252.

Nip drive shaft 244 is rotationally driven about axis 260 in response to receiving torque from torque source 30 via dwell mechanism 252 and clutch 248. When nip drive shaft 244 is being driven in a counterclockwise direction as seen in FIG. 1, nip drive shaft 44 engages a sheet within nip 56 and drives a sheet further along media path 24. When nip drive shaft 44 is not being driven (in neutral), nip drive shaft 44 cooperate with pinch rollers 240 such that the leading edge of a sheet cannot pass through and beyond nip 256. As the leading edge of the sheet is driven against nip 256, the leading edge is squared in nip 256, lessening skew of a sheet.

Friction clutch 246 comprises a clutch operably coupled to nip drive shaft 244 and configured to impede rotation of nip drive shaft 244 when torque is not being supplied to drive shaft 244 by clutch 248. Friction clutch 246 inhibits the leading edge of the sheet from being pushed through nip 256 when drive shaft 244 is not being driven. In alternative embodiments where nip drive shaft 44 is driven in a reverse direction (clockwise as seen in FIG. 1) during deskewing, friction clutch 246 may be omitted. In particular embodiments where nip drive shaft 244 is stationary during deskewing, friction clutch 246 may also be omitted.

Clutch 248 comprises a mechanism configured to selectively operably couple or connect torque source 30 to nip drive shaft 244 via dwell mechanism 252. Clutch 248 actuates between a driving state in which clutch 248 transmits torque to drive shaft 244 so as to drive drive shaft 244 in a direction to advance media along media path 24 (counterclockwise as seen in FIG. 1) and a deskewing state. In the embodiment illustrated, clutch 248 is resiliently biased towards the driving state. In the embodiment illustrated, when in the deskewing state, clutch 248 interrupts or ceases transmission of torque from torque source 30 to drive shaft 244. As a result, drive shaft 44 is in a substantially stationary or neutral state.

Figures 5, 5A:
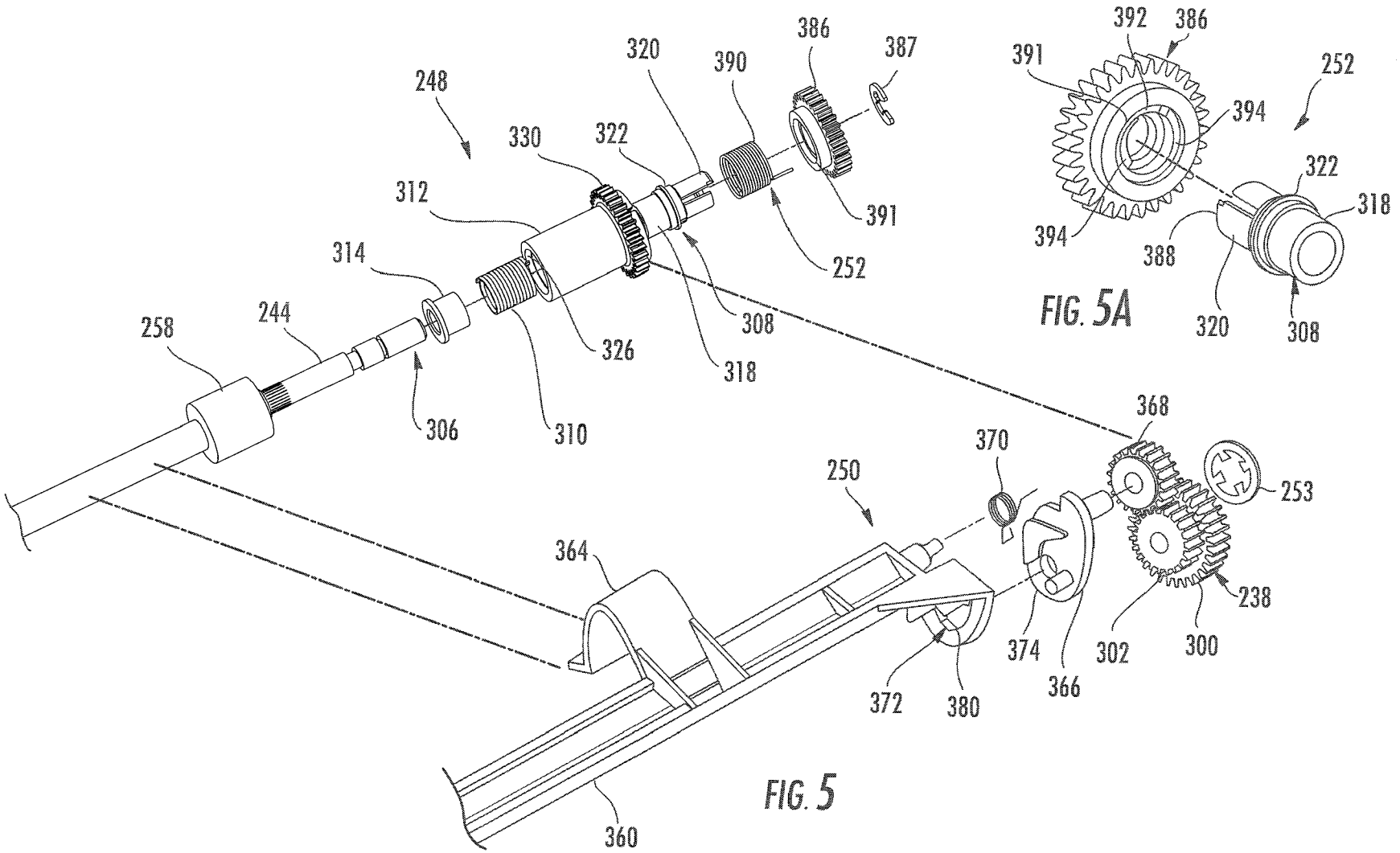
FIG. 5 is an exploded perspective view of deskewing system of FIG. 4 according to an example embodiment.
FIG. 5A is an enlarged perspective view of a portion of a dwell mechanism of the deskewing system of FIG. 5 according to an example embodiment.
Figure 6:
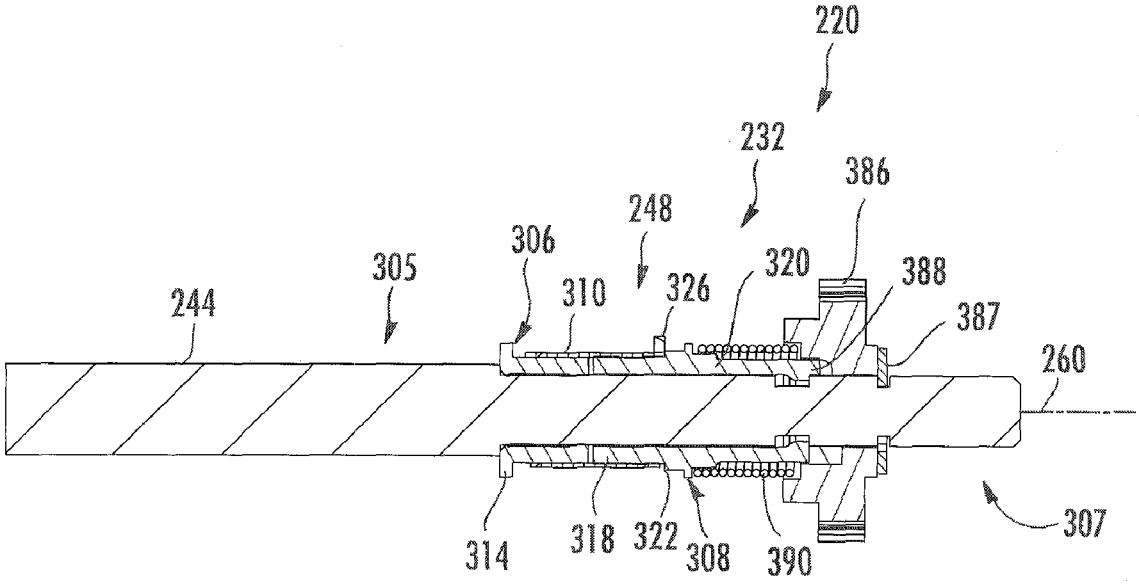
FIG. 6 is a sectional view of a clutch and the dwell mechanism of the deskewing system of FIG. 4 according to an example embodiment.

FIGS. 5 and 6 illustrate clutch 248 in more detail. As shown by FIG. 5, clutch 248 includes collar 306, hub 308, torsion spring 310 and sleeve 312. Collar 306 comprises a structure fixed against rotation to nip drive shaft 244 and providing a surface disposed within spring 310 that is configured to be frictionally engaged by spring 310. Collar 306 includes a shoulder 314 which limits axial movement of spring 310. In other embodiments, collar 306 may be omitted where spring 310 directly interacts with drive shaft 244.

Hub 308 comprises a cylinder rotationally supported about drive shaft 244 having a first-end portion 318, a second end portion 320 joined to dwell mechanism 252 and an intermediate shoulder 322. End portion 318 is received within spring 310 so as to be frictionally engaged by spring 310. End portion 320 supports portion of dwell mechanism 252 as will be described hereafter. Shoulder 322 actually retains spring 310. Although hub 308 is illustrated as a cylinder rotationally supported about drive shaft 244, in other embodiments, hub 308 may alternatively comprise a solid shaft having a first and rotationally supported within sleeve 312 and a second and rotationally supported by dwell mechanism 252.

Spring 310 (sometimes referred to as a wrap spring) comprises a torsion spring extending about portions 314 and 318 of collar 306 and hub 308, respectively. Spring 310 has an end or tang secure to sleeve 312. Spring 310 is configured such that in the absence of torque applied by sleeve 312 or in the absence of rotation of spring 310 by sleeve 312, spring 310 tightens or constricts about both collar 306 and hub 308. The constriction is sufficient such friction between the outer circumferential surfaces of collar 306 and hub 308 and spring 310 is large enough to inhibit relative rotation about axis 260, effectively locking collar 306 (and nip drive shaft 244) to hub 308. When spring 310 is in such a constricted state, locking the drive shaft 244 to hub 308, clutch 248 is in the driving state such that torque received by clutch 248 via dwell mechanism 252 is transmitted to nip drive shaft 244. Spring 310 resiliently biases clutch 248 to this driving state.

Sleeve 312 comprises a structure connected to spring 310 that is configured to interface between trigger 250 and spring 310. Sleeve 312 receives force from trigger 250 to rotate spring 310 to selectively expand spring 310. Such expansion of spring 310 increases the diameter of spring 310 to reduce contact and friction between spring 310 and portions 314 and 318 of collar 306 and hub 308. As a result, expansion of spring 310 permits hub 308 to rotate relative to collar 306 and drive shaft 244, effectively interrupting transmission of torque across clutch 248 to nip drive shaft 244.

In the particular embodiment illustrated, sleeve 312 includes a gear ring 330 configured to receive torque from trigger 250 so as to rotate sleeve 312 about axis 260 so as to expand spring 310. When force is no longer applied to gear ring 330 and when gear ring 330 is disengaged from trigger 250, sleeve 312 and spring 310 resiliently return to their more relaxed state in which spring 310 once again is constricted against and about collar 306 and hub 308, returning clutch 248 to the driving state.

In other embodiments, clutch 248 may have other configurations. For example, in lieu of being rotationally driven by torque applied to gear ring 330, sleeve 312 may alternatively receive torque in other fashions. In one embodiment, sleeve 312 may receive torque via a pulley and associated belt. In another embodiment, sleeve 312 may receive torque via a sprocket and associated chain. In still other embodiments, sleeve 312 may be rotated via a cam and cam follower pair.

Although clutch 248 is illustrated as being resiliently biased towards the driving state in which spring 310 is constricted about to surfaces of collar 306 and hub 308, in other embodiments, spring 310 may alternatively be disposed within bores of collar 306 and hub 308, wherein rotation of the spring decreases the diameter the spring 310 and constricts spring 310 out of frictional interlocking engagement with inner circumferential surfaces of the bores. In still other embodiments, clutch 248 may comprise other clutch arrangements and mechanisms for selectively connecting and disconnecting to rotating members.

Trigger 250 comprises an arrangement of structures or components configured to utilize force exerted by a sheet upon trigger 250 to mechanically actuate clutch 248 between the driving state and the deskewing state. In the particular embodiment illustrated, force exerted upon trigger 250 by a sheet is transmitted by trigger 250 so as to move an intermediate movable structure which connects or disconnects a separate distinct source of torque or motion (such as torque from torque source 30) to gear ring 330 of clutch 248 to rotate sleeve 312 and spring 310. Rotation of sleeve 312 and spring 310 changes clutch 248 to the deskewing state.

Figure 4:
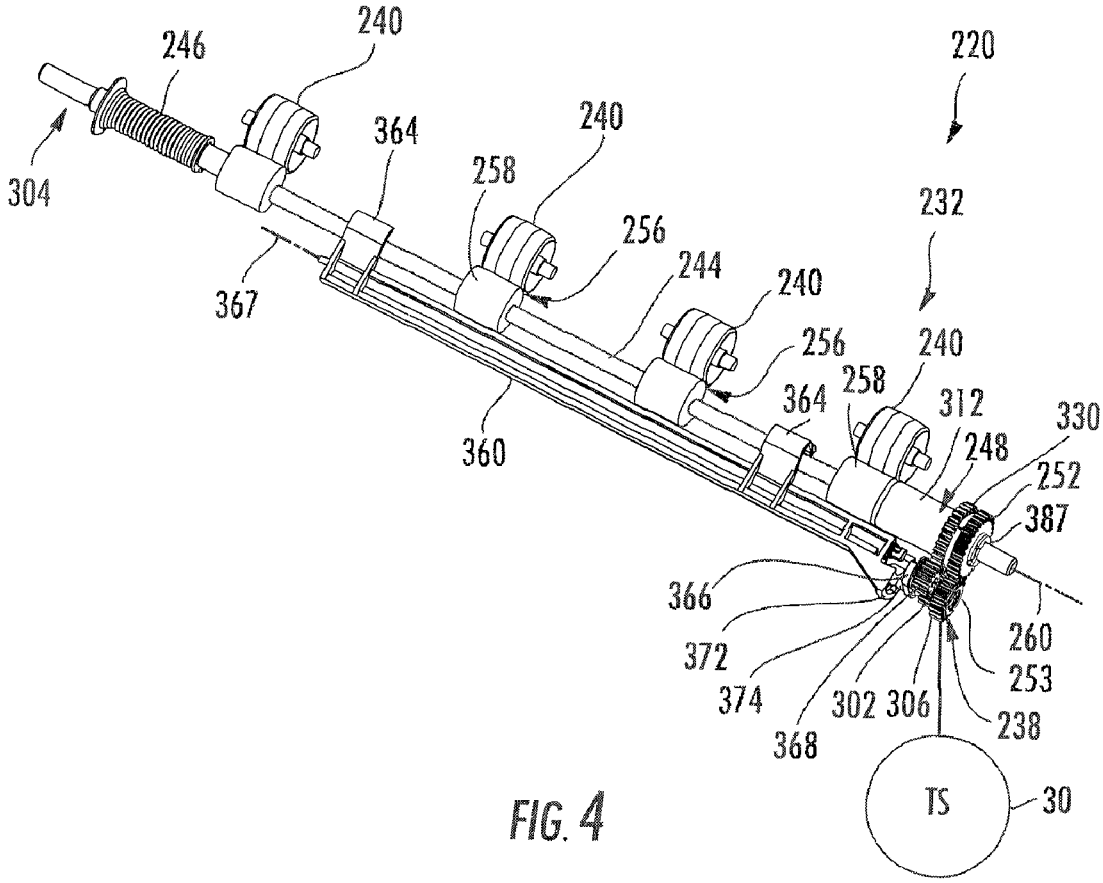
FIG. 4 is a perspective view of a deskewing system of the media interaction system of FIG. 3.

As shown by FIGS. 4 and 5, trigger 250 includes paddle support 360, paddles 364, swing arm 366, gear 368, spring 370, cam 372 and cam follower 374. Paddle support 360 comprises an elongate structure extending substantially parallel to axis 260 from which paddles 364 extend. Support 360 is rotationally or pivotably supported about axis 367 by housing 236 (shown in FIG. 3). Axis 367 extends substantially parallel to axis 260. Supports 360 is pivoted about axis 367 as a result of and in response to forces exerted upon paddles 364 by a sheet driven and approaching nip 256. Support 360 further transmits such force to swing arm 366 via cam 372 and a cam follower 374.

Paddles 364 comprise tabs, hooks or projections extending from support 360. Paddles 364 are actually spaced from one another along an axis 367 and are configured to extend across or at least partially into media path 24 (shown in FIG. 3). Paddles 364 pivot or otherwise move between a media path intercepting position and a withdrawn position. In the example illustrated, paddles 364 pivot from a first side of axis 260 to a second opposite side of axis 260. Paddles 364 are configured to encounter a sheet moving along media path 24 and to move so as to transmit force and motion to move swing arm 366.

Swing arm 366, gear 368, spring 370, cam 372 and a cam follower 374 serve as an actuator for actuating clutch 248 between the driving state and the deskewing state. Swing arm 366 rotationally supports gear 368 in meshing engagement with gear 302 of torque splitter 238. Swing arm 366 is pivotably supported by housing 236 (shown in FIG. 3) between a clutch engaged position in which gear 368 is in engagement with gear ring 330 and a disengaged position in which gear 368 is out of engagement with gear ring 330. In one embodiment, swing arm 366 is pivotably supported by the same axle extending from housing 236 and rotationally supporting torque splitter 238.

Spring 370 is mounted between paddle support 360 and housing. Spring 370 resiliently biases swing arm 366 to the clutch engaging position while also resiliently biasing paddles 364 to the media path intercepting position. In other embodiments, distinct springs may be provided for providing such bias forces.

Cam 372 and cam follower 374 cooperate to transmit force from paddles 364 and paddle support 360 to swing arm 366 against the bias of spring 370 to move gear 368 to the clutch disengaged state. Cam 372 includes cam surface 380 and extends from or is operably coupled to paddle support 360 so as to move in response to movement of paddle support 360 about axis 367. Cam follower of 374 extends from or is otherwise operably coupled to swing arm 366 into engagement with cam surface 380.

Figure 7:
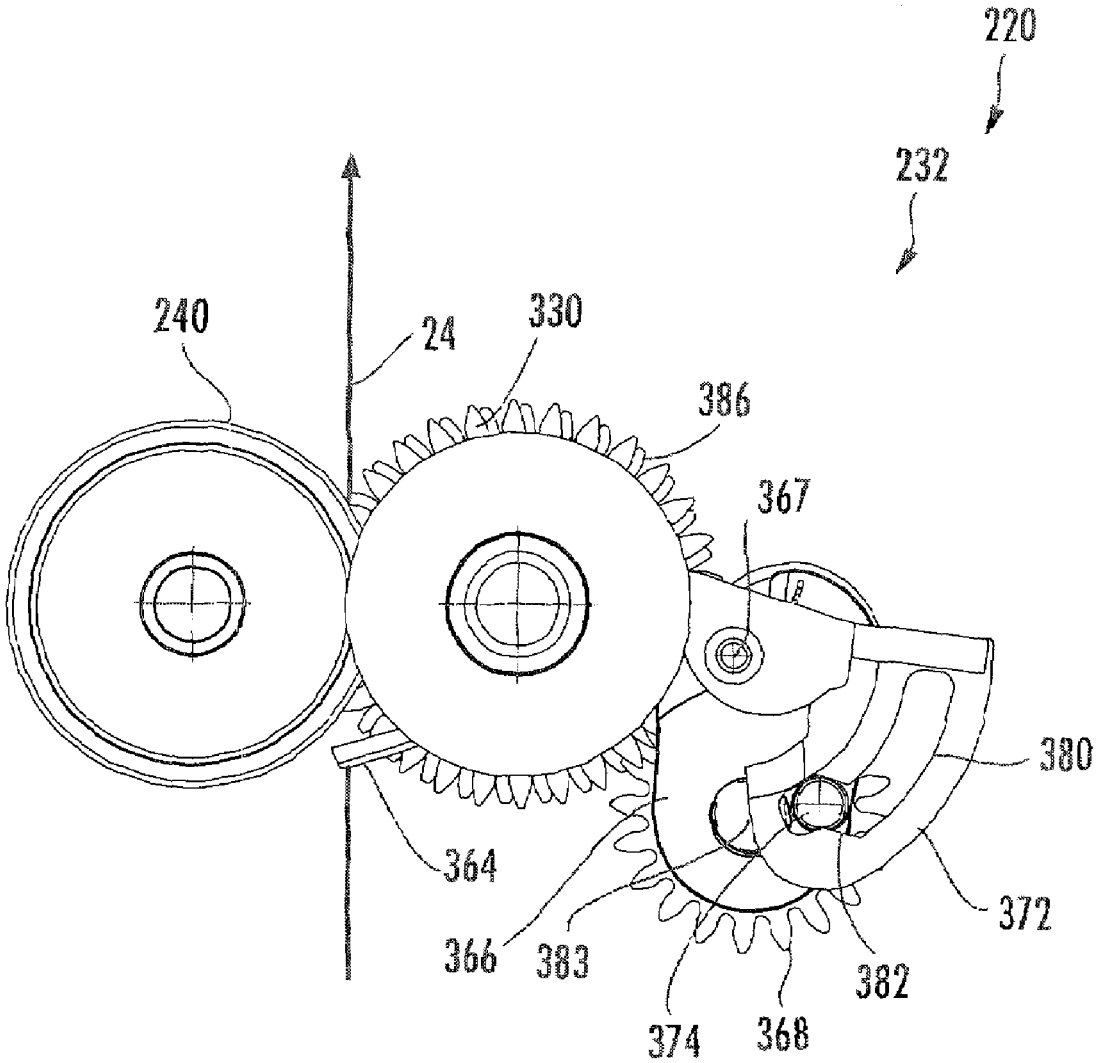
FIG. 7 is a side elevational view of a first side of the deskewing system of FIG. 4 while in an untriggered state according to an example embodiment.

FIG. 7 illustrates one example profile of cam surface 380. In the particular example illustrated, cam surface 380 is configured such that have a dwell 382. Dwell 382 comprises a portion of cam surface 380 which when moving against cam follower 374 transmits a lesser amount of motion or no motion to cam follower 374. As a result, pivotal movement of swing arm 366 and gear 368 to the clutch engaged position may be delayed after initial engagement and movement of paddles 364 by a driven sheet of media. This delay may provide sufficient time for a leading edge of a sheet to be squared against nip 256 (shown in FIG. 4) prior to nip drive shaft 244 and its rollers 258 being driven in the media advancing direction. In some embodiments, the delay provided by dwell 382 may be sufficient such that dwell mechanism 252 may be omitted, wherein hub 308 is directly operably connected to torque splitter 238. In other embodiments, this dwell 382 may be omitted. In still other embodiments, cam 372 and cam follower 374 may have other configurations or may be replaced with other motion transmitting mechanisms.

Dwell mechanism 252 comprises a mechanism configured to delay transmission of force or motion. In the particular embodiment illustrated, dwell mechanism 252 comprises a lost motion arrangement located between clutch 248 and torque source 30. Dwell mechanism 252 delays transmission of torque to clutch 248 when clutch 248 has been changed to the driving state. As a result, even after clutch 248 has been changed to the driving state by trigger 250, nip drive shaft 244 remains in the deskewing state until the dwell provided by dwell mechanism 252 has been consumed. Dwell mechanism 252 provides a dwell time sufficient for the leading edge of the sheet to move past trigger 250 and to be squared against nip 256 prior to rotation of nip drive shaft 244 in the media advancing direction. Once the dwell has been consumed, drive shaft 244 is rotationally driven in the media advancing direction to move the squared sheet along media path 24.

FIGS. 5 and 5A illustrate dwell mechanism 252 in more detail. Dwell mechanism 252 includes gear 386, tab or projection 388 and torsion spring 390 (shown in FIG. 5). Gear 386 comprises a spur gear rotationally supported by nip drive shaft 244 such that gear 386 may rotate relative to and about nip drive shaft 244 when nip drive shaft 244 is stationary. Gear 386 if axially retained on shaft 244 with clip 387 (shown in FIG. 5). As shown by FIG. 5, gear 386 includes an internal bore 392 configured to rotationally receive end portion 320 of hub 308. Bore 392 includes a circumferential or arcuate channel or slot 391 configured to slidably and rotationally receive projection 388. Slot 391 defines two shoulders 394 on its opposite ends and against one of which projection 388 engages to transfer motion in a direction.

Spring 390 comprises a torsion spring having one end connected to gear 386 and a second end connected to hub 308. Spring 390 serves as a lost motion spring by resiliently biasing projection 388 against one of shoulders 394. The time that it takes for projection 388 to move against the bias of spring 390, across the length of the slot and into engagement with the other of shoulders 394 to transfer motion constitutes the dwell time provided by this dwell mechanism 252. In other embodiments, dwell mechanism 252 may have other configurations. In some embodiments, dwell mechanism 252 may be omitted or may be provided at other locations. In embodiments where dwell mechanism 352 is provided at other locations or as other configurations, gear 386 may be affixed to or coupled to hub 308 so as to rotate with hub 308.

Figure 8:
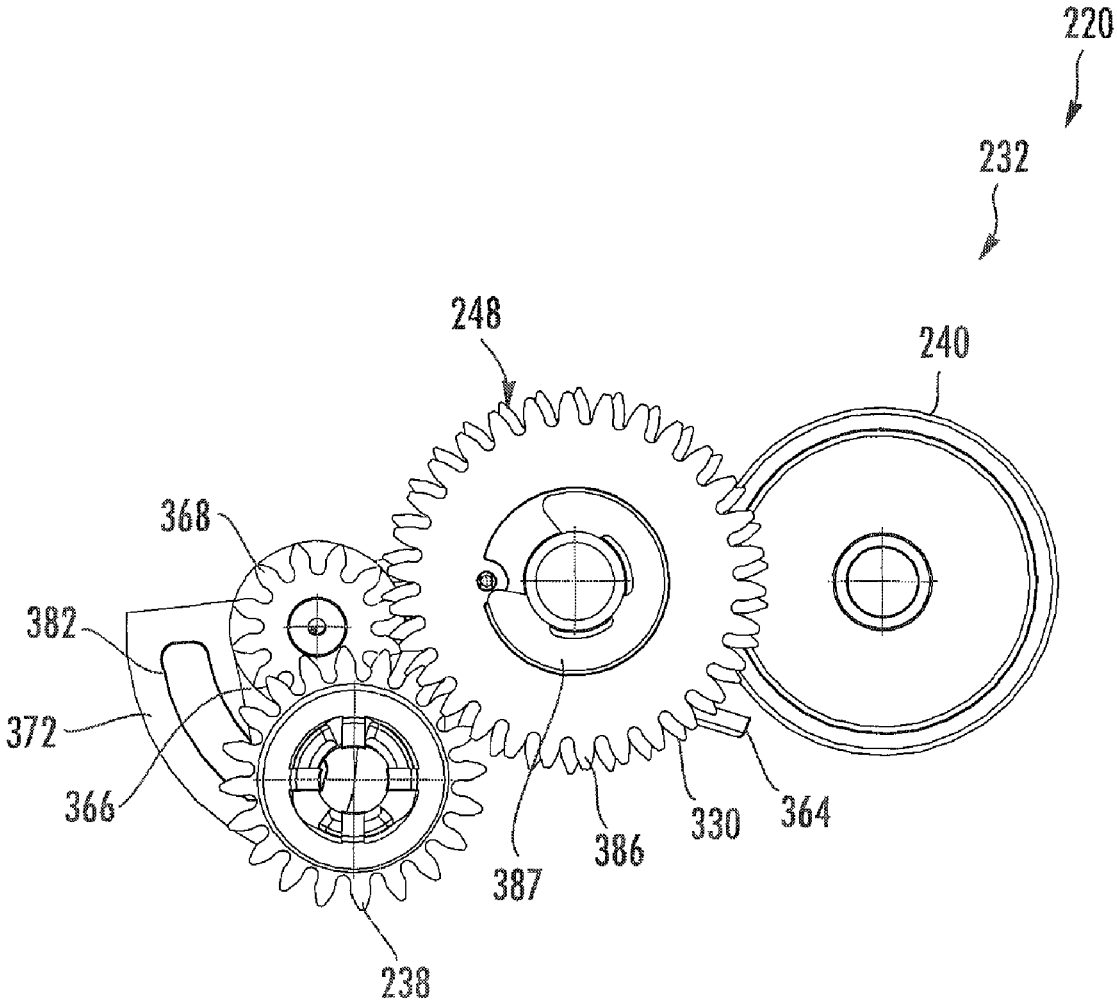
FIG. 8 is another side elevational view of the deskewing system of FIG. 7 according to an example embodiment.

FIGS. 7-10 illustrate operation of deskewing system 232. FIGS. 7 and 8 illustrate deskewing system 232 prior to paddles 364 being engaged by a driven sheet of media along media path 24. As shown by FIG. 7, paddles 364 extend into and intercept media path 24. As shown by FIG. 8, swing arm 366 is resiliently biased by spring 370 (shown in FIG. 5) towards the clutch engaging position in which gear 368 is in meshing engagement with gear ring 330 of sleeve 312. During such time, torque source 30 (shown in FIG. 4) supplies torque via torque splitter 238 to both gear 368 of trigger 250 and gear 386 of dwell mechanism 252. Gear 368, biased into engagement with gear ring 330 by spring 370, transmits such torque to rotate sleeve 312. Rotation of sleeve 312 expands spring 310 against the bias of spring 310 out of frictional interlocking engagement with collar 306. As a result, sleeve 312 and spring 310 rotate about nip drive shaft 244 relative to collar 306.

Rotation of sleeve 312 and expansion of spring 310 (shown in FIGS. 5 and 6) also enlarges spring 310 out of frictional interlocking engagement with hub 308. As a result, the torque supplied to gear 386 via torque splitter 238 rotates gear 386, spring 390 and hub 308 in near substantial unison with hub 308 while rotating relative to sleeve 312 and spring 310. Thus, torque is not transmitted from hub 308 to sleeve 312 or to nip drive shaft 244. Clutch 248 is in the deskewing state.

Figure 9:
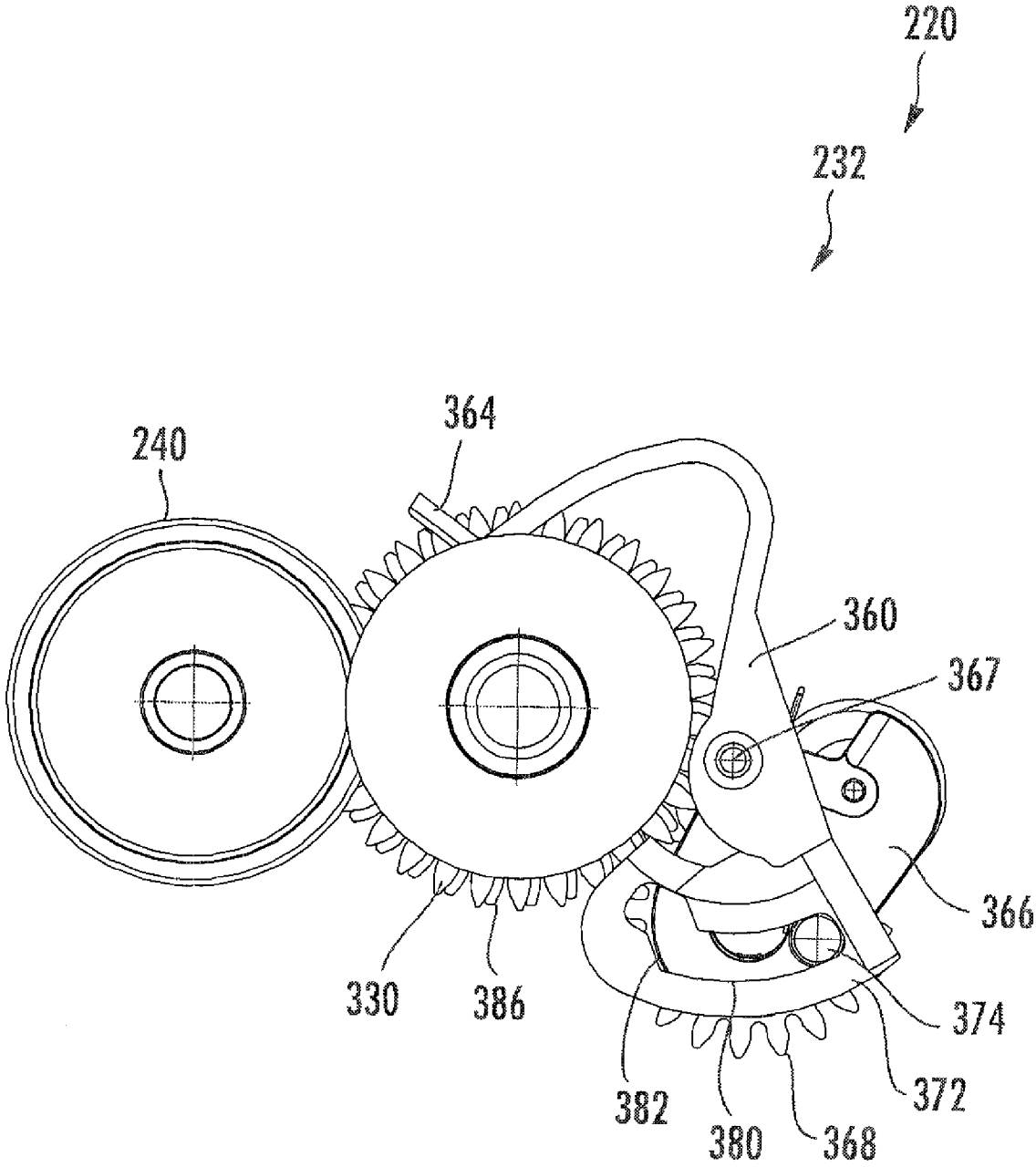
FIG. 9 is a side elevational view of the first side of the deskewing system of FIG. 4 while in a triggered state according to an example embodiment.
Figure 10:
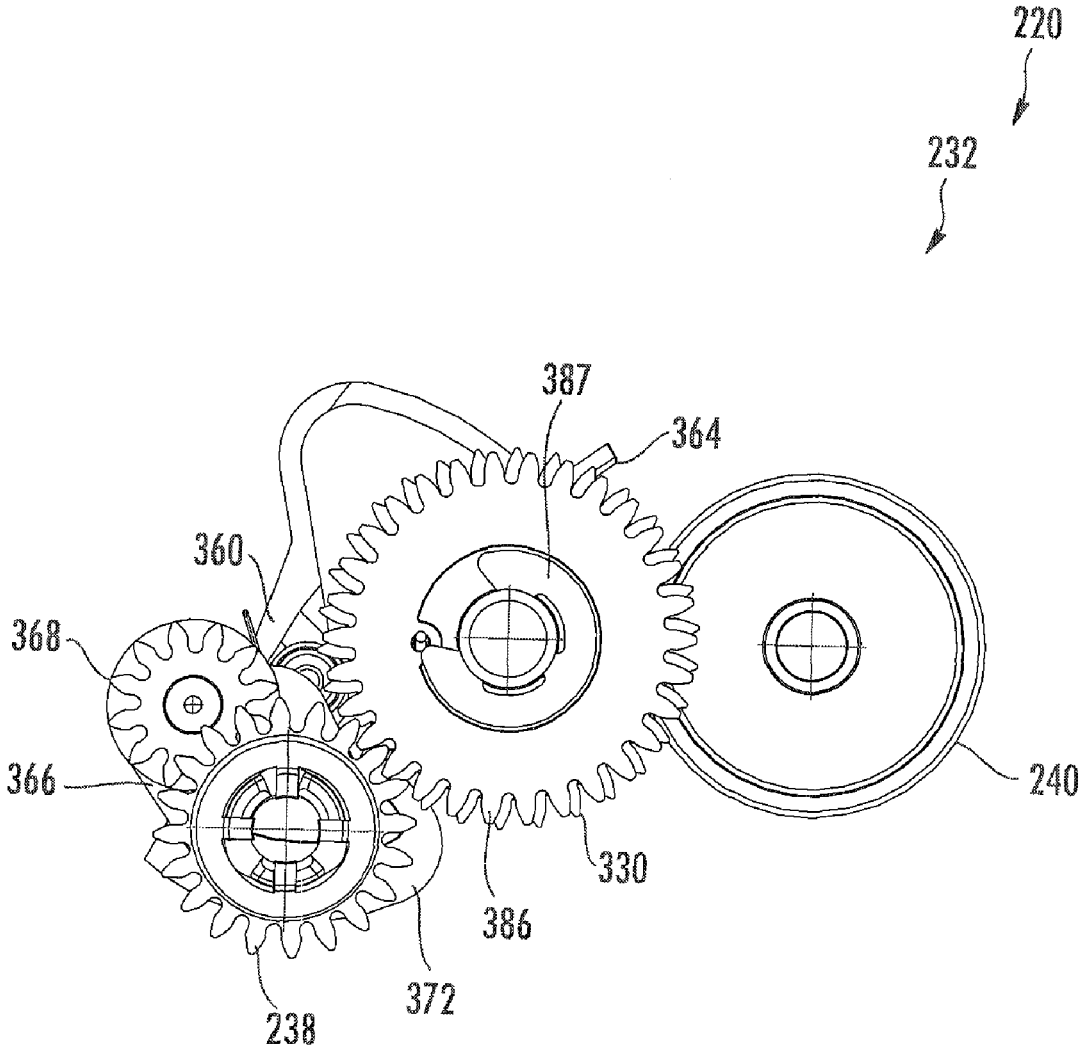
FIG. 10 is another side elevational view of the deskewing system of FIG. 9 according to an example embodiment.

FIGS. 9 and 10 illustrate deskewing system 232 after a sheet has tripped trigger 250. As shown by FIG. 9, upon being engaged by a leading edge of a driven sheet (not shown), paddles 364 transmit force to paddle support 360 so as to pivot paddle support 360 and cam 372 about axis 367. This results in cam follower 374 moving along and against cam surface 380 to pivot swing arm 366 about axis 383 (shown in FIG. 7) so as to pivot gear 368 against the bias of spring 370 to the clutch disengaged position in which gear 368 is out of engagement with gear ring 330 of sleeve 312 of clutch 248. As a result, being no longer driven by gear 368, sleeve 312 rotates in a direction opposite to the direction in which sleeve 312 is rotated by gear 368 under the bias of spring 370. During such time, spring 310 tightens and constricts about both collar 306 and hub 308, frictionally interlocking hub 308 to collar 306. No longer being able to freely rotate relative to spring 310 and sleeve 312, hub 308 initially resists rotation. At the same time, gear 386 of dwell mechanism 252 continues to rotate under torque supplied via torque splitter 238, winding spring 390 until the length of slot 391 has been rotated across projection 388 and projection 388 abuts an opposite shoulder of slot 391. At such point in time, gear 386 transmits torque to hub 308 which transmits torque to collar 306 and drive shaft 244 via spring 310.

During the dwell provided dwell 382 and during the dwell provided by dwell mechanism 252 (the time that it takes for spring 390 to be wound and the time for projection 388 to move from one shoulder to the other shoulder of slot 391), the leading edge of the driven sheet is squared against nip 256. Upon consumption of the dwell, torque from torque source 30 (shown in FIG. 4) is transmitted across torque splitter 238, gear 386, hub 308, Spring 310 and collar 306 to drive shaft 244 to rotate drive shaft 244 in the media advancing direction. As a result, the squared sheet is driven through nip 256 further along media path 24.

After the trailing edge of the sheet has been driven sufficiently along media path 24 and out of engagement with paddles 364, spring 370 (shown in FIG. 5) resiliently pivots paddle support 360 about axis 367 to move paddles 364 back to the media path intercepting state shown in FIG. 7. As a result, swing arm 366 also pivots about axis 383 (shown in FIG. 7) to move gear 368 back into engagement with gear ring 330 of sleeve 312. In this clutch engaged state, gear 368 once again transmits torque received from torque splitter 238 to gear ring 330 to rotate gear ring 330 and sleeve 312 in a direction so as to expand spring 310 and release collar 306 and hub 308. Consequently, clutch 248 is actuated to the deskewing state in which torque is no longer transmitted to nip drive shaft 244. Free to rotate relative to spring 310, hub 308 rotates under the bias of spring 390 to once again position projection 388 of hub 308 against the opposite shoulder of slot 391. Nip drive shaft 244 is once again ready for deskewing a subsequent sheet.

Overall, like deskewing systems 32 and 132, deskewing system 232 deskews sheets using mechanically triggered actuation of the clutch. A result, use and reliance upon sensors is reduced. Because system 232 may be actuated between a driving state and a deskewing state while torque is supplied by torque source 30 in a single direction, multiple deskewing systems may be driven by a single torque source 30, wherein such multiple deskewing systems may be in the same or different states. Because torque source 30 does not necessarily have to be reversed to change states of deskewing system 232, media throughput is less affected by the deskewing of sheets.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. An apparatus comprising:

a drive shaft supporting a first surface forming a nip with a second surface;

a clutch operably coupled to the drive shaft and actuatable between a first state in which the drive shaft is driven in a first direction to advance a sheet and a second state in which the drive shaft is either not driven or is driven in a second direction opposite to the first direction; and a trigger operatively coupled to the clutch to utilize force exerted by the sheet upon the trigger to mechanically actuate the clutch between the first state and the second state.

2. The apparatus of claim 1, wherein the drive shaft is not driven when the clutch is in the second state.

3. The apparatus of claim 1, wherein the trigger is configured to mechanically actuate the clutch to the first state utilizing the force exerted by the sheet upon the trigger.

4. The apparatus of claim 1, wherein the trigger comprises a plurality of paddles axially spaced along the drive shaft.

5. The apparatus of claim 1, wherein the clutch initially transmits torque to the drive shaft after a predetermined dwell time following engagement of the trigger by the sheet.

6. The apparatus of claim 1, wherein the trigger is configured to pivot between a media path intercepting position and a withdrawn position in response to receiving force from the sheet.

7. The apparatus of claim 1 further comprising a media path along which the sheet moves, wherein the trigger is resiliently biased towards a media path intercepting position.

8. The apparatus of claim 1, wherein the drive shaft is rotatable about an axis and wherein the trigger is pivotably supported to pivot from a first side of the axis to a second side of the axis opposite the first side of the axis in response to receiving force from the sheet.

9. The apparatus of claim 1, wherein the clutch is actuatable between a coupling state in which the drive shaft is operably coupled to a torque source and a decoupled state in which the drive shaft is not operably coupled to the torque source, wherein the clutch is resiliently biased towards one of the coupling state and the decoupled state and wherein the trigger is configured to actuate the clutch between the coupling state and the decoupled state.

10. The apparatus of claim 9, wherein the trigger is operatively coupled to the torque source to utilize torque from the torque source to actuate the clutch.

11. The apparatus of claim 10, wherein the trigger comprises:

at least one paddle configured to be engaged by the sheet; and an actuator operably coupled to the at least one paddle, the actuator configured to move between an engaged position in which the actuator is engagement with the clutch and a disengaged position, wherein the actuator moves between the engaged position and the disengaged position in response to force transmitted from the sheet by the at least one paddle.

12. The apparatus of claim 11, wherein the trigger comprises:

one of a cam and a cam follower operably coupled to the at least one paddle; and the other of a cam and a cam follower operably coupled to the actuator, wherein the cam and the cam follower cooperate to transmit force from the at least one paddle to the actuator to move the actuator between the engaged position and the disengaged position.

13. The apparatus of claim 11, wherein the clutch comprises:

a torsion spring adjacent one surface coupled to the drive shaft and another surface coupled to the torque source; and a member operatively coupled to the actuator to be selectively rotated by the actuator so as to change a diameter of the torsion spring such that the torsion spring frictionally engages or disengages the surface coupled to the drive shaft and the surface coupled to the torque source.

14. The apparatus of claim 13, wherein the actuator comprises:

a first gear coupled to the member;

a second gear operably coupled to the torque source; and a swing arm operably coupled to the trigger and carrying a third gear, wherein the swing arm movably supports the third gear between an engaged position in which the third gear transmits torque between the first gear and the second gear to actuate the clutch to the decoupled state and a disengaged position.

15. The apparatus of claim 9 further comprising a dwell mechanism coupled between the torque source and the clutch such that transmission of torque to the drive shaft upon the clutch being actuated to the coupled state is delayed for a predetermined time.

16. The apparatus of claim 15, wherein the dwell mechanism comprises:

a first rotatable member having an arcuate slot; and a second rotatable member having a tab resiliently biased against one end of the arcuate slot, wherein one of the first rotatable member and the second rotatable member is operably connected to the torque source and wherein the other of the first rotatable member and the second rotatable member is selectively connected to the drive shaft by the clutch.

17. The apparatus of claim 1 further comprising a friction clutch operatively coupled to the drive shaft to impede rotation of the drive shaft when the clutch is in the second state.

18. The apparatus of claim 1 further comprising a media interaction device.

19. The apparatus of claim 1 further comprising:

a second drive shaft supporting a third surface forming a second nip with a fourth surface;

a second clutch operably coupled to the second drive shaft and actuatable between a first state in which the second drive shaft is driven in a first direction to advance the sheet and a second state in which the second drive shaft is either not driven or is driven in a second direction opposite the first direction; and a second trigger configured to utilize force exerted by the sheet upon the second trigger to mechanically actuate the second clutch between the first state and the second state.

20. The apparatus of claim 1, wherein the trigger is operatively coupled to the clutch such that the force exerted by the sheet upon the trigger is transmitted to the clutch such that the force physically moves a portion of the clutch.

21. The apparatus of claim 1 further comprising:

a swing arm;

a first driven gear carried by the swing arm; and a second gear operatively coupled to the clutch, wherein the trigger is operatively coupled to the swing arm such that force exerted by the sheet upon the trigger is transmitted by the trigger to the swing arm to pivot the swing arm and move the first gear into meshing contact with the second gear or out of meshing contact with the second gear.

22. The apparatus of claim 1 wherein the second surface comprises a pinch roller opposite to the first surface and forming the nip.

23. The apparatus of claim 1, wherein the drive shaft is driven in the second direction when in the second state.

24. The apparatus of claim 1 further comprising a media input operable to drive a leading-edge of the sheet against the nip while the drive shaft is in the second state.

25. An apparatus comprising:

a drive shaft supporting a surface forming a nip with another surface;

a clutch operably coupled to the drive shaft and actuatable between a first state in which the drive shaft is driven in a first direction to advance media and a second state in which the drive shaft is either not driven or is driven in a second direction opposite to the first direction; and a trigger operatively coupled to the clutch to utilize force exerted by a sheet upon the trigger to mechanically actuate the clutch between the first state and the second state, wherein the trigger is resiliently biased towards a media path intercepting position and wherein the clutch initially transmits torque to the drive shaft after a predetermined dwell time following engagement of the trigger by the sheet.

26. An apparatus comprising:

a drive shaft supporting a surface forming a nip with another surface;

a clutch operably coupled to the drive shaft and actuatable between a first state in which the drive shaft is driven in a first direction to advance media and a second state in which the drive shaft is either not driven or is driven in a second direction opposite to the first direction; and a trigger operatively coupled to the clutch to utilize force exerted by a sheet upon the trigger to mechanically actuate the clutch between the first state and the second state, wherein the clutch is actuatable between a coupling state in which the drive shaft is operably coupled to a torque source and a decoupled state in which the drive shaft is not operably coupled to the torque source, wherein the clutch is resiliently biased towards one of the coupled state and the decoupled state, wherein the trigger is configured to actuate the clutch between the coupled state and the decoupled state and wherein the clutch initially transmits torque to the drive shaft after a predetermined dwell time following engagement of the trigger by the sheet.

* * * * *